United States Patent [19]

Pickering et al.

[11] Patent Number: 4,981,161

[45] Date of Patent: Jan. 1, 1991

[54] SEAT BELT WEBBING HAVING MULTIFILAMENT AND MONOFILAMENT YARNS

[75] Inventors: Ross I. Pickering, Point Claire; Roger Dame, Quebec, both of Canada

[73] Assignee: LaGran Canada, Inc., Lachine, Canada

[21] Appl. No.: 433,446

[22] Filed: Nov. 3, 1989

Related U.S. Application Data

[63] Continuation of Ser. No. 272,461, Nov. 17, 1988, abandoned.

[51] Int. Cl.[5] ..... D03D 15/00

[52] U.S. Cl. ..... 139/383 R; 139/420 R; 139/432

[58] Field of Search ..... 139/383 R, 431, 432, 139/420 R; 280/801

[56] References Cited

U.S. PATENT DOCUMENTS

| | | | |
|---|---|---|---|
| 3,136,343 | 6/1974 | Firing | 139/431 |
| 4,294,467 | 10/1981 | Frantom | 280/801 |
| 4,298,648 | 11/1981 | Turnbull . | |
| 4,313,473 | 2/1982 | Reiter | 139/432 |
| 4,344,463 | 8/1982 | Muller et al. | 139/432 |
| 4,370,784 | 2/1983 | Turnbull . | |
| 4,440,197 | 4/1984 | Masuda | 139/431 |
| 4,473,617 | 9/1984 | van Leenwen et al. . | |
| 4,600,626 | 7/1986 | Ogata . | |
| 4,660,605 | 4/1987 | Koch . | |
| 4,688,598 | 8/1987 | Klos | 139/383 R |
| 4,800,929 | 1/1989 | Watanabe | 139/383 R |

FOREIGN PATENT DOCUMENTS

| | | | |
|---|---|---|---|
| 116866 | 7/1984 | European Pat. Off. . | |
| 123472 | 10/1984 | European Pat. Off. . | |
| 2356754 | 3/1978 | France | 139/432 |
| 1229123 | 1/1971 | United Kingdom . | |
| 1430404 | 6/1976 | United Kingdom . | |

OTHER PUBLICATIONS

Muller, Automatic Narrow Fabric Needle Loom Operating Instructions, cover sheet and paragraph 38:07 and "Compensation Springs" illustration; Mar. 1981.

*Primary Examiner*—Andrew M. Falik
*Attorney, Agent, or Firm*—Nixon & Vanderhye

[57] ABSTRACT

A seat belt (safety belt) webbing has lateral stiffness, low longitudinal stiffness, abrasion resistance, and user comfort provided by a soft, round edge of the webbing. In a loom, a pick needle is used to move both a monofilament and multifilament yarn together across the full width of the loom shed. A higher tension is applied to the monofilament yarn so that the monofilament yarn does not protrude beyond the edges of the webbing. In the selvedge (marginal) portions of the web a single ply warp yarn is provided, while in the central portion a double ply warp yarn is provided. The selvedge portions may have a reverse twill weave. Two catchcord yarns, a binder thread and a locking thread, are knit at one edge portion of the webbing.

19 Claims, 1 Drawing Sheet

SEAT BELT WEBBING HAVING MULTIFILAMENT AND MONOFILAMENT YARNS

This is a continuation of application Ser. No. 07/272,461, filed Nov. 17, 1988, now abandoned.

BACKGROUND AND SUMMARY OF THE INVENTION

Seat belt (also called safety belt) systems have evolved significantly as these systems have become standard equipment in all different types of cars and other vehicles, and as different designs of seat belts have been provided for both active and passive systems. It has been recognized that in order to provide an effective and comfortable seat belt system, it is very desirable that the seat belt webbing itself have a number of desired characteristics.

Desirable seat belt webbing typically should have good lateral stiffness and good resilience across the width of the webbing in order to avoid "roping" conditions, or folding of the webbing, that could result in malfunctioning of the seat belt system. Comfort to the user of the seat belt is enhanced by the use of a soft edge, yet the webbing must still have good abrasion resistance. Further, it is necessary that the webbing be relatively thin, and have low longitudinal stiffness, in order to provide good winding and lock-up characteristics.

According to the present invention, a woven seat belt webbing is provided which has all of the desirable characteristics set forth above. The good lateral stiffness and resilience across the width of the webbing that is, properties sufficient to avoid "roping" conditions, or other folding of the webbing, that could result in malfunctioning of the seat belt system is achieved by providing both monofilament and multifilament filling yarns. The monofilament yarn is a very rigid yarn and provides excellent fold resistance and good resiliency. However it is important that it not protrude at the edges of the webbing. This is accomplished according to the invention by moving the monofilament and multifilament yarns together as one across the full width of the shed with a pick needle while applying a higher tension to the monofilament yarn than the multifilament yarn.

Comfort to the user is achieved according to the present invention by providing a soft and round edge appearance. A soft and round edge appearance is provided in part by controlling the filling tension of the monofilament yarn, as described above; and by providing a particular catchcord formation along one edge of the webbing. This is also accomplished by providing a smaller warp yarn in the selvedge portions of the webbing and a second, larger, warp yarn in the central portions of the webbing, the first warp yarn having smaller dimensional properties than the second yarn so that a round and soft edge appearance is provided. Typically, single ply warp yarns are provided in the selvedge portions and double ply warp yarns of the same nominal denier or detex in the central portion. This also allows the production of a narrower and thinner webbing with soft edges for a given tensile strength, which is very desirable.

Low longitudinal stiffness, which when combined with the thinner webbing offers good winding and lock-up characteristics, is also provided by the use of the smooth monofilament filling yarn. With the thinner webbing, web storage is also substantially increased.

Despite the round and soft edge appearance, seat belt webbing according to the invention also has good abrasion resistance. Again, the monofilament/multifilament construction provides good abrasion resistance in part as a result of the improved lateral stiffness provided thereby which results in a product with good stability. Utilizing the webbing according to the invention, less edge filamentation, less rippling, and less curvature after many cycles of use, can be expected.

The method of making seat belt webbing according to the invention preferably utilizes a needle loom. The method comprises the following steps: (a) Providing warp yarns in a shed. (b) Weaving filling yarns with the warp yarns, the filling yarns comprising a monofilament yarn and a multifilament yarn, by moving the monofilament and multifilament yarns together as one across the full width of the shed with a pick needle, and by applying a different tension to the monofilament yarn than the multifilament yarn so that the monofilament yarn does not protrude on the edges of the webbing. And, (c) providing stitching along one edge of the webbing to hold the filling yarns in place along that edge. Step (a) is practiced by providing different warps for the selvedge portions than the central portion in the shed so that the webbing has a soft and round appearance. This is preferably accomplished by providing single ply warp yarns in the selvedge portions and double ply warp yarns, with each ply of the same nominal denier and detex as the selvedge yarns, in the central portions. Also, steps (b) and (c) are preferably practiced by knitting two catchcord yarns at the edge portion, using a binder thread and a locking thread as the two catchcord yarns, and by controlling the tension of the locking yarn to assure an even edge and a cushion over the filling yarns, and controlling the tension of the binder yarn to allow the filling yarn to pull itself and the binder yarn from the edge of the webbing.

It is the primary object of the present invention to provide a single layer woven belt with good lateral stiffness and good resilience across its width, low longitudinal stiffness, good abrasion resistance, and a soft round edge appearance, and a method of construction thereof. This and other objects of the invention will become clear from an inspection of the detailed description of the invention and from the appended claims.

DETAILED DESCRIPTION OF THE DRAWINGS

Figure 1:
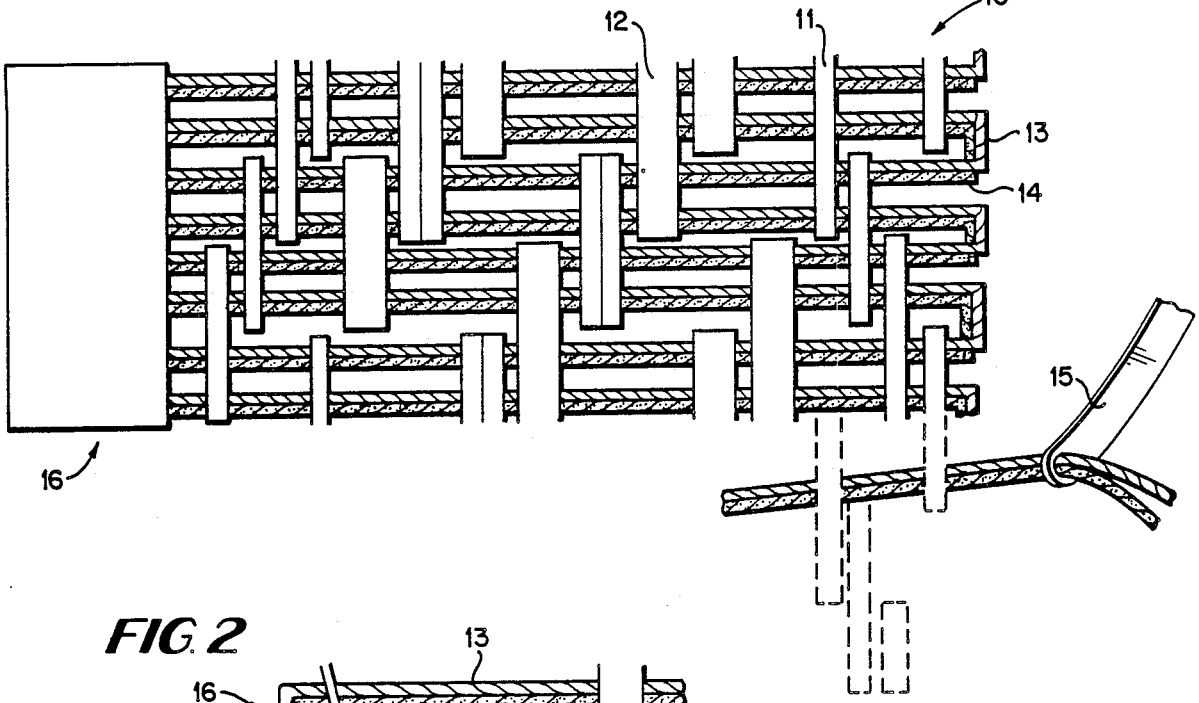
FIG. 1 is a schematic illustration of a top view of an exemplary webbing according to the invention, while being made.

FIG. 1 schematically illustrates generally by reference numeral 10 safety belt webbing according to the invention. The major components of the webbing include the warp yarns, which are preferably of two different types 11, 12, and the filling yarns, which also are preferably of two different types, 13, 14. The webbing 10 is woven on a conventional loom, which includes a pick needle 15.

The warp yarns 11 preferably are single ply yarns of a given denier or detex. The denier or detex will be selected depending upon the particular fibers of the yarn (e.g. polyester, nylon, or the like), and the particular end use requirements. The warp yarns 11 are provided in the selvedge (marginal, edge) portions of the webbing 10, while in the central portion the warp yarns 12 are provided. The warp yarns 12 have greater dimensional properties than the warp yarns 11, the warp yarns 11 having small enough dimensions so that a round and soft edge appearance is provided, providing good comfort to the user, utilizing the webbing 10. Preferably, the warp yarns 12 are double ply warp yarns with each ply having the same nominal denier or detex as the yarns 11, i.e. the warp yarns 12 are double the size of the yarns 11. As illustrated in FIG. 1, the yarns 11, 12 have substantially the same length. The exact width of the central portion of the webbing 10 (that is that portion comprising the yarns 12 of greater dimensions) depends upon the particular end use, but typically the central portion would be—by a significant amount—the majority of the webbing 10.

The filling yarn 13 comprises a multifilament yarn that is perpendicular to the warp yarns 11, 12, and a monofilament yarn 14. The monofilament and multifilament yarns 14, 13, are woven parallel to each other across the full width of the loom shed (the webbing 10) preferably utilizing a single filling arm needle (pick needle) 15. The pick needle 15 carries the yarns 13, 14 together and simultaneously back and forth across the width of the webbing 10 during weaving. However, in order to provide soft edges to the webbing 10 a higher tension is exerted on the monofilament yarn 14 than on the multifilament yarn 13. This higher tension, which is applied by conventional means, ensures that the monofilament yarn 14 does not protrude past the edges of the webbing 10. This differential tension is accomplished, for example, in a conventional Jakob Muller Ltd. loom by using a differently sized or spring constant compensation spring in the conventional feed of the multifilament yarn from a storage feeder to a weft guide, than in the conventional feed of the monofilament yarn from a storage feeder to a weft guide. The size or spring constant of the compensation spring will determine the tension.

Figure 2:
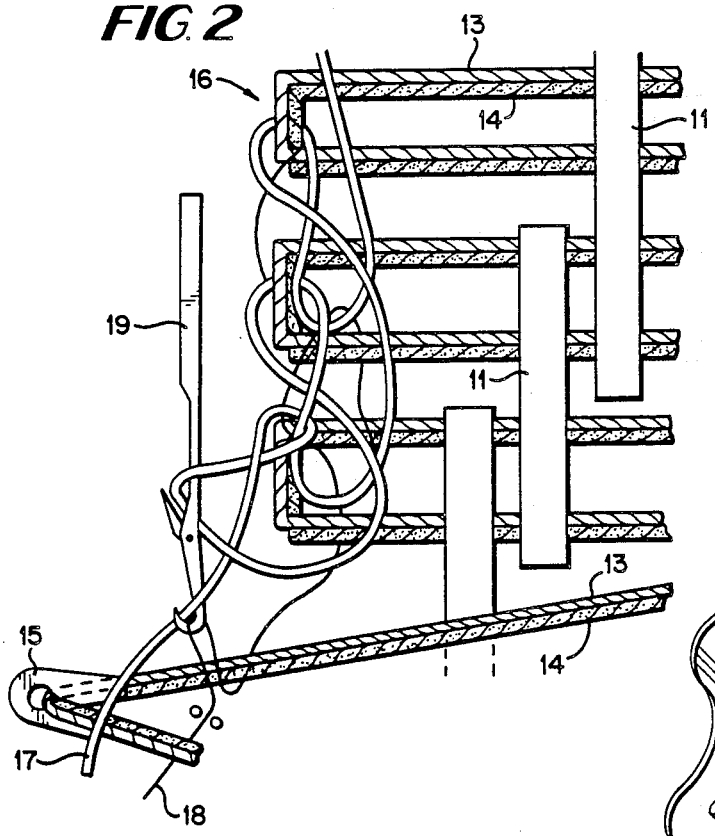
FIG. 2 is a detail top schematic view of the lefthand edge of the webbing of FIG. 1 showing the manner of construction thereof, while being made.

According to the present invention it is also desirable to provide a knitted configuration at an edge formation, shown generally by reference numeral 16 in FIG. 1, along the lefthand side of the webbing 10. This edge configuration is illustrated more clearly in FIG. 2. The edge formation 16 can be significant in providing a smooth, soft round edge for the belting 10, and for efficient and effective production of the product. Edge knitting per se in belting and the like is known from U.S. Pat. Nos. 4,313,473 and 4,344,463, for example. The edge knitting according to the invention is practiced by knitting two catchcord yarns at the edge portion, a locking yarn 17, and a binder yarn 18, utilizing a single knitting needle 19. The tension is controlled on the locking yarn to assure an even edge and a cushion over the filling yarns 13, 14. The tension on the binder yarn 18 is separately controlled to allow the filling yarn to pull itself and the binder yarn 18 from the edge of the webbing.

When producing the webbing 10 according to the invention, the exact materials, deniers or detex, or the like for the yarns, and the exact weave pattern for the main body of the belting, or knitting pattern for the edge formation 16, are not critical. However it is desirable that all synthetic yarns be utilized, and according to one aspect of the invention the central portion of the webbing 10, in which the larger warp elements 12 are provided, is provided by a normal weave, whereas the selvedge portions, containing the smaller yarn elements 11, is woven in a reverse twill weave. This reverse twill weave, and the closer packing of the yarns 11 together than is provided for the yarns 12, results in a "round edge" effect with a smooth surface.

Thus according to the invention a method of making safety belt webbing is provided which utilizes a needle loom. Warp yarns 11, 12 are provided in a shed, and then the filling yarns are woven with the warp yarns. The filling yarns comprise a monofilament yarn and a multifilament yarn, and the weaving is accomplished by moving the monofilament and multifilament yarns 13, 14 together as one across the shed full width while applying a different (greater) tension to the monofilament yarn 14 than the multifilament yarn 13 so that the monofilament yarn 14 does not protrude on the edges of the webbing 10. One also provides a knitted configuration at the edge formation 16 of the webbing 10 to hold the filling yarns 13 and 14 in place along that edge. The knitted configuration is provided by knitting two catchcord yarns 17, 18 at the edge portion, using a binder yarn on which the tension is controlled to allow the filling yarn to pull itself and the binder yarn from the edge of the webbing, and controlling the tension of the locking yarn to assure an even edge and a cushion over the filling yarns.

The invention also comprises a method of making a single layer woven safety belt webbing by weaving a warp yarn with filling yarns across the width of the entire shed, and providing a smaller warp yarn 11 in the selvedge portions of the webbing 10 a larger warp yarn 12 in the central portions of the webbing 10. The smaller warp yarn 11 has smaller dimensional properties than the larger yarn 12 so that a round and soft edge appearance is provided. This is preferably accomplished by providing single ply warp yarns 11 in the selvedge portions and double ply warp yarns 12 of the same nominal denier or detex in the central portion.

Figure 3:
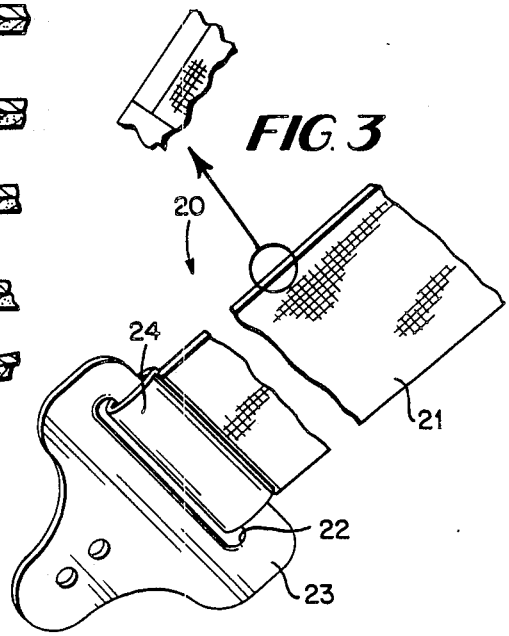
FIG. 3 is a top perspective view of a seat belt made with the webbing according to the invention.

Utilizing the webbing 10 according to the invention it is possible to produce a seat belt 20 (see FIG. 3). The seat belt 20 comprises a belt or strap portion 21 comprised of the webbing 10 according to the invention which passes through an opening 22 in the metal locking element 23, and doubled over and stitched to itself at 24 so that it is permanently fastened to the element 23.

One exemplary webbing according to the invention is constructed as follows:

The selvage warp yarns 11 are single ply polyester yarns having a dtex of about 940. The central portion warp yarns 12 are double ply yarns, comprising two yarns each identical to one of the yarns 11. The multifilament yarn 13 comprises a polyester yarn having a dtex of about 470, while the monofilament yarn 14 comprises a polyester yarn having a dtex of about 440. The locking yarn 17 comprises a polyester yarn having a dtex of about 167, while the binder yarn 18 comprises a polyester yarn having a dtex of about 245.

The selvage portions (containing the single ply yarns 11) are woven with a reverse twill weave to the central portion of the webbing (containing the warp yarns 12).

The webbing 10 produced in this manner, utilized in a seat belt 20, has good lateral stiffness and good resilience across the width of the webbing so that roping or folding does not typically occur. Also the belt strap portion 21 has good user comfort since it has a soft, smooth, round edge. The seat belt 20 belt strap portion 21 also has low longitudinal stiffness and is relatively thin so that it conforms readily to the take-up reels, will rewind with low force, and allows a high volume of web storage.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent products and procedures.

What is claimed is:

1. A method of making safety belt webbing utilizing a needle loom, having a pick needle, for weaving warp and filling yarns, comprising the steps of:

(a) providing warp yarns in successive sheds;

(b) weaving filling yarns with the warp yarns, the filling yarns comprising a monofilament yarn and a multifilament yarn, by moving the monofilament and multifilament yarns together as one across the full width of the successive sheds with a single pick needle, and by applying a different tension to the monofilament yarn than the multifilament yarn while weaving, so that the monofilament yarn does not protrude on the edges of the webbing; and (c) providing a knitted configuration along one edge of the webbing to hold the filling yarns in place along that edge.

2. A method as recited in claim 1 wherein the webbing has selvedge and central portions, and wherein step (a) is practiced by providing different warp ends for the selvedge portions than for the central portion so that the webbing has a soft and round, not tubular, edge appearance.

3. A method as recited in claim 2 wherein step (a) is further practiced by providing single ply warp yarns in the selvedge portions and double ply warp yarns, with each ply of the same nominal denier or detex as the selvedge yarns, in the central portion.

4. A method as recited in claim 2 wherein steps (b) and (c) are practiced by knitting two catchcord yarns at said edge portion.

5. A method as recited in claim 4 wherein steps (b) and (c) are further practiced by: using a binder thread and a locking thread as the two catchcord yarns, and by controlling the tension on the locking yarn to assure an even edge and a cushion over the filling yarns, and controlling tension of the binder yarn to allow the filling yarn to pull itself and the binder yarn from the edge of the webbing. catchcord yarns are knit with the same knitting needle.

6. A method as recited in claim 5 wherein a single knitting needle is provided for the cathcord yarns, and wherein the catchcord yarns are knit with the single knitting needle.

7. A method as recited in claim 4 wherein a single knitting needle is provided for the cathcord yarns, and wherein the catchcord yarns are knit with the single knitting needle.

8. A method as recited in claim 1 wherein steps (b) and (c) are practiced by knitting two catchcord yarns at said edge portion.

9. A method as recited in claim 8 wherein steps (b) and (c) are further practiced by: using a binder thread and a locking thread as the two catchcord yarns, and by controlling the tension on the locking yarn to assure an even edge and a cushion over the filling yarns, and controlling tension of the binder yarn to allow the filling yarn to pull itself and the binder yarn from the edge of the webbing.

10. A method as recited in claim 8 wherein the catchcord yarns are knit with the same knitting needle.

11. A method as recited in claim 1 wherein step (b) is practiced by providing the monofilament and multifilament filling yarns of substantially the same length.

12. A single layer woven belt with lateral stiffness and resilience across its width, low longitudinal stiffness, abrasion resistance, and a soft, round, not tubular, edge appearance, having a central portion and selvedge portions, comprising multifilament and monofilament filling yarns of substantially the same length in the central and selvedge portions and extending the entire width of the belt, the monofilament yarns being arranged in the belt so as not to protrude beyond the edges of the selvedge portions.

13. A belt as recited in claim 12 having a first warp yarn in the selvedge portions and a second warp yarn in the central portion, the second warp yarn having larger, cross-sectional dimensional properties than the first warp yarn.

14. A belt as recited in claim 13 wherein the smaller warp yarn is a single ply yarn having a given denier or detex, and wherein the larger warp yarn is a double ply yarn with each ply of the same denier or detex as the smaller warp yarn.

15. A belt as recited in claim 13 further comprising a knitted configuration at one edge of the belt to hold the filling yarns at the edge and to assure an even edge and a cushion over the filling yarns.

16. A belt as recited in claim 15 wherein a knitted configuration is provided by a locking yarn and a binder yarn.

17. A seat belt comprising:

a belt webbing attached to a metal belt locking element, the bet webbing comprising a single layer woven belt with lateral stiffness and resilience across its width, low longitudinal stiffness, abrasion resistance, and a soft round, not tubular, edge appearance, having a central portion and selvedge portions; a first warp yarn in the selvedge portions and a second warp yarn in the central portion, the second warp yarn having larger cross-sectional dimensional properties than the first warp yarn; and multifilament and monofilament filling yarns of substantially the same length in the central and selvedge portions and extending the entire width of the belt, the monofilament yarns being arranged in the belt so as not to protrude beyond the edges of the selvedge portions.

18. A single layer woven belt with lateral stiffness and resilience across its width, low longitudinal stiffness, and abrasion resistance, having a central portion and selvedge portions, comprising: multifilament and monofilament filling yarns extending the entire width of the belt, the monofilament yarns being arranged in the belt so as not to protrude beyond the edges of the selvedge portions;

a first warp yarn in the selvedge portions and a second warp yarn in the central potion, the second warp yarn having larger cross-sectional dimensional properties than the first warp yarn; and the first warp yarn is the single ply yarn having a given denier or detex, and the second warp yarn is a double ply yarn with each ply of the same denier or detex as the first warp yarn.

19. A belt as recited in claim 14 wherein the selvedge portions are woven in a reverse twill weave.

* * * * *